US005144562A

United States Patent [19]

Stikkelorum et al.

[11] Patent Number: 5,144,562

[45] Date of Patent: Sep. 1, 1992

[54] SYSTEM FOR COLLATING AND BINDING SIGNATURES TO PRODUCE CUSTOMIZED BOOKS OR MAGAZINES

[76] Inventors: Simon G. Stikkelorum, Roemlaan 21, 5237 EA 's-Hertogenbosch; Albertus G. C. Jaspers, Luthlisingel 28, 4105 GA Culemborg, both of Netherlands

[21] Appl. No.: 501,921

[22] Filed: Mar. 28, 1990

[30] Foreign Application Priority Data

Mar. 29, 1989 [NL] Netherlands ..... 8900772

[51] Int. Cl.[5] ..... G06F 15/20; B65H 39/02

[52] U.S. Cl. ..... 364/478; 270/54; 270/58

[58] Field of Search ..... 364/468, 478, 464.01, 364/464.02, 464.03, 466; 270/54, 58, 1.1

[56] References Cited

U.S. PATENT DOCUMENTS

| | | | |
|---|---|---|---|
| 3,819,173 | 6/1974 | Anderson et al. | 270/54 |
| 4,121,818 | 10/1978 | Riley et al. | 364/478 X |
| 4,500,083 | 2/1985 | Wong | 364/464.02 X |
| 4,674,052 | 6/1987 | Wong et al. | 364/466 |
| 4,799,661 | 1/1989 | Nail | 270/54 |
| 4,923,189 | 5/1990 | Nail | 270/54 |

*Primary Examiner*—Joseph Ruggiero
*Attorney, Agent, or Firm*—Fleit, Jacobson, Cohn, Price, Holman & Stern

[57] ABSTRACT

System for collating and binding signatures to produce customized versions of boks or magazines, comprising a conveyer running along a number of workstations, including feeder stations, printer stations and a stitching station and comprising a number of checkpoints, one for each of the abovementioned stations. The system includes furthermore a reject, station and a computer system to control the various stations. This computer system comprises a number of controllers, one for each of said stations coupled to a central computer by means of a network. During operation of the system each controller is loaded with suitable software enabling the controller to control the functioning of the assigned station independent of the other controllers and whereby the transfer of a message indicating the malfunctioning of one of said stations from the respective controller to the central processor will cause the central processor to send a message to the printer stations, feeder stations and stitching station downstream of the station n which the malfunctioning occured instructing these stations to stop the further production of the book or magazine influenced by said malfunctioning to send a message to the reject station to reject said non-completed book or magazine and to send messages to all stations to update the data defining the magazines or books to be produced such that a replacement for the rejected non-completed book or magazine will be produced.

9 Claims, 2 Drawing Sheets

Figure 1:
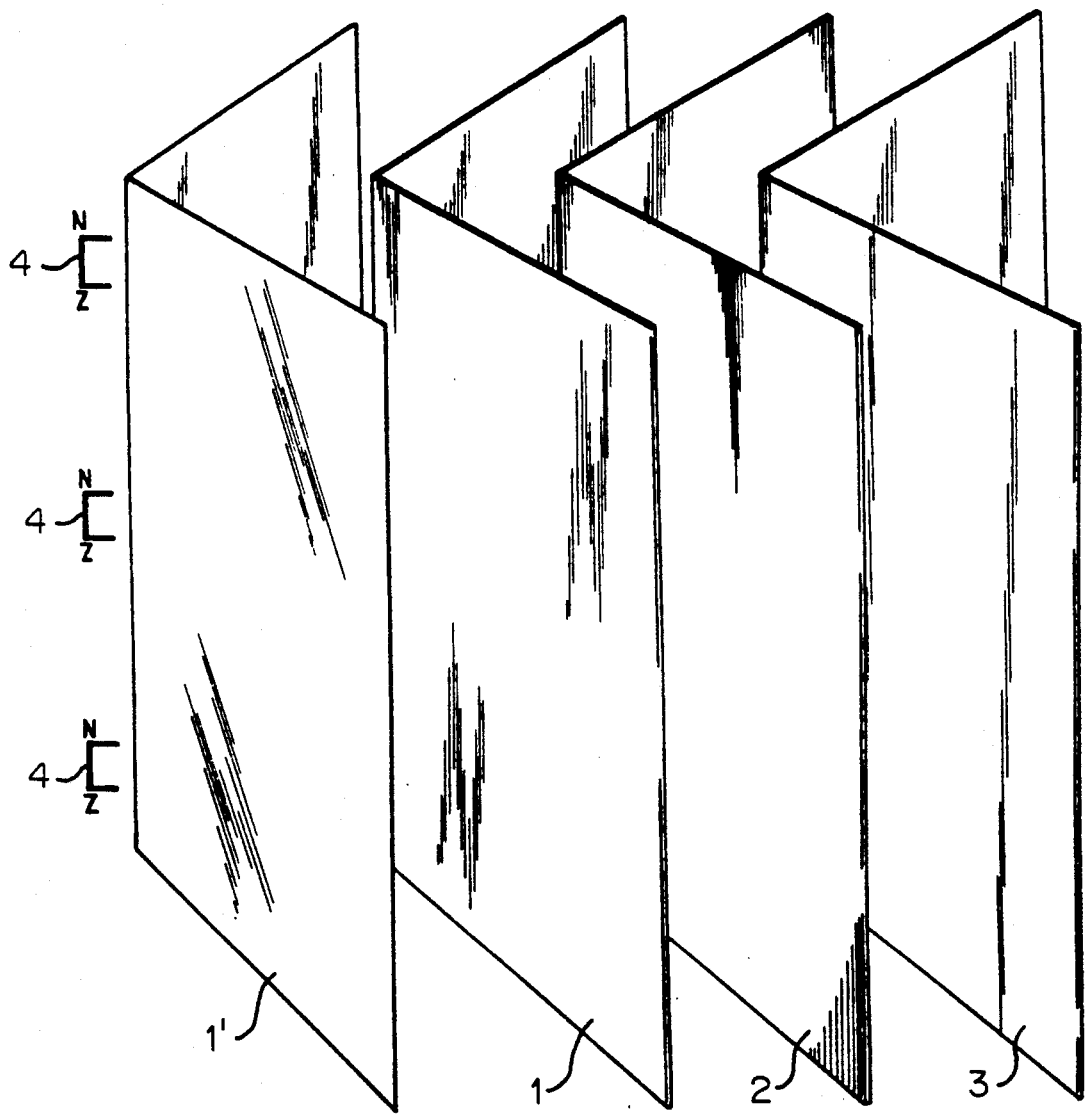

SYSTEM FOR COLLATING AND BINDING SIGNATURES TO PRODUCE CUSTOMIZED BOOKS OR MAGAZINES

The invention relates to a system for collating and binding signatures to produce customized versions of books or magazines, comprising

- a conveyer running along a number of workstations, said workstations including
  - a number of feeder stations each destined to feed one signature to said conveyer to form a collation of signatures,
  - a number of printer stations each destined to print a predetermined text on the upper signature of the collation passing the station on said conveyer,
  - a stitching station destined to bind the collated signatures on the conveyer to obtain a book or magazine
- a number of checkpoints, one for each of the abovementioned stations, destined to check the correct functioning of the respective station,
- a reject station downstream of the abovementioned stations destined to remove defective books or magazines,
- a computer system destined to receive data from a source of data relating to the embodiment of each book or magazine to be produced and information relating to the functioning of the various stations and destined to transfer control messages to said various stations.

A system of this type is described in the U.S. Pat. No. 4,674,052. The computer system of this prior art collating and binding system comprises a central computer which through a distribution network is coupled to the various stations and to the various checkpoints. The distribution network functions as an I/O-controller and directs incoming data supplied by the various checkpoints to the computer and directs on the other hand data and instructions from the central computer to the various workstations. Information about the addresses, to which the customized books or magazines will be mailed, are read by the central computer from a magnetic tape unit. Based on these address data and based on preprogrammed parameters the central computer will generate control messages to the various workstations to control the functioning thereof.

Because the central processor has to control simultaneously a number of workstations a rather powerful computer has to be used functioning in a multitasking mode. The use of a less powerful computer will result in the introduction of waiting periods before control messages are transmitted to the various workstations which in turn will result in a restriction of the operating speed of said work stations.

The prior art system is obviously designed as a ready made system for collating and binding one specific magazine or book. Some widely sold magazines have such a large circulation that it is acceptable to setup a collating and binding system solely for the purpose of getting that specific magazine ready to be issued. However, such a specifically dedicated system has no flexibility at all. As indicated above obviously the system described in the abovementioned U.S. patent is destined to be used for one specific widely distributed magazine whereby various local editions can be collated and binded depending on the postal code of the subscribers.

If a collating and binding system has to be used for processing a number of different magazines and/or books in different quantities and with varying customization specifications it is a first requirement that the whole system has a large degree of flexibility. It should not only be possible to change rather quickly the number of feeder stations and the number and positions of the printer stations but also the computer system destined to control the various feeder and printing stations should be embodied such that the adaption thereof to a new configuration of workstations can be carried out preferably by non qualified personal and preferably without reprogramming the system. Furthermore it should be possible to insert other types of workstations in the line such as card blowers and so on.

An object of the herein described invention is now to provide a system with enough flexibility to fulfill the needs of those companies who are handling the collating and binding operations for books or magazines which have a relatively restricted circulation with a medium or small number of copies, at least such a small number of copies that the investments in a relatively rigid and dedicated system of the type described above are not justifiable, however, without restricting the use of the system according to the invention to issues with medium or small circulation.

According to the invention the system described in the first paragraph is characterized in that said computer system comprises

- a number of controllers, one for each of said stations, each controller being destined to receive information from the checkpoint assigned to the same station and to output commands to the respective station to control the functioning thereof,
- a central processor destined to receive the data from said data source and to generate control messages to each of the controllers,
- a communication network to which all controllers as well as the central processor are connected by uniform connecting means to transfer control messages and data from the central processor to the various controllers and to transfer information about the functioning of the various stations from the controllers to the central station, whereby during operation of the system each controller is loaded with suitable software enabling the controller to control the functioning of the assigned station independent of the other controllers and whereby the transfer of a message indicating the misfunctioning of one of said stations from the respective controller to the central processor will cause the central processor to send a message to the printer stations, feeder stations and stitching station downstream of the station in which the misfunctioning occured instructing these stations to stop the further production of the book or magazine influenced by said misfunctioning, to send a message to the reject station to reject said non completed book or magazine and to send messages to all stations to update the data defining the magazines or books to be produced such that a replacement for the rejected non completed book or magazine will be produced.

The use of a communications network with uniform connecting means to interconnect the workstations and the central computer ensures that the after changing the configuration of a collating and binding line the workstations can be connected to the central computer again by just plugging the connector of each workstation in one of the available plugs of the network.

The introduction of a separate controller for each workstation ensures furthermore a certain degree of independence assisting further in obtaining the desired degree of flexibility. Each controller can be embodied as a special purpose computer dedicated to control the corresponding workstation. The controller only needs information from the central computer about the way in which the workstation has to function. Not only the flexibility will be increased also the operating speed of the system can be increased because the amount of instructions and data to be exchanged between the central computer and each of the workstations will be significantly reduced compared to the above described prior art system.

A further advantage of building some intelligence in the workstations by combining the mechanical workstations with electronic controllers is a reduction of the operating power of the central computer. A less expensive computer will be sufficient to carry out the remaining jobs.

By stopping any further actions in relation to a partly made book or magazine which is to become rejected unnecessary waste of paper will be avoided. It is remarked that in the prior art system obviously all workstations are functioning just normally by adding further signatures to the pile and by eventually carrying out printing operations although the central computer is already informed that the specific book or magazine has to be rejected.

Systems of the underlying type are in general used in environments which, for instance because of dust and vibrations, are rather hostile for electronic computers. To avoid problems in that respect it is preferred that the system comprises a further processor, functioning as said abovementioned source of data, coupled to said central processor and destined to receive information about the persons or organizations who will receive one of the books or magazines produced by the system and customized to their specific needs, which further processor is programmed to convert said information into data relating to the books or magazines to be produced by the system and to transfer said lastmentioned data to the central processor.

It is in this preferred embodiment not nessecary to have access to the central computer. The input means of the further processor and the disk drives thereof can be used to receive data about the specific customizing requirements of the magazines or books to be produced. In fact the central computer does not need any input means or moving parts at all and will receive all information from the further processor. Therefor there is no objection against housing the central computer in a protective enclosure.

Although downstream of the stitching station the production line can be extended with a trimmer and label printer functioning synchronously with the upstream stations as in the configuration described in U.S. Pat. No. 4,674,052, such a way of extending the line does not improve the flexibility of the system. On the contrary, the trimmer and labeling apparatus have to be selected or adjusted such that synchroneous operation with the other workstations will be possible.

A far more flexible solution is offered in a preferred embodiment of the system which according to the invention is characterized in that the system comprises furthermore a station for trimming the binded books or magazines which have passed the rejection station, a wrapping station and a buffer station, a separate controller and checkpoint being assigned to said wrapping station, whereby the trimming station receives the books or magazines from said conveyer and supplies the trimmed books or magazines to said buffer station which is positioned at the end of the conveyer, and whereby the buffer station places the received books or magazines in a queue from which the books or magazines or supplied to the wrapping station at a rate which is dependent on the functioning speed of said wrapping station.

The insertion of a buffer station between the first section of the line, where the actual collating and binding operations are carried out, and the second section or extension of the line in which the completed books or magazines are wrapped and eventualy bundled ensures that both sections can function asynchronously.

If addressing means have to be used in the second section of the line it is important to ensure that a specifically customized book or magazine will indeed be mailed to that person or that organization for whom the customization was carried out. Addresses can be placed on the outside of the wrapper for instance by directly printing the address on the wrapper using one or more printing mechanisms or for instance by printing the address on a label using a label printer and adhering the printed label onto the outside of the wrapper.

According to a preferred embodiment the system is in that respect characterized in that the wrapping station is combined with a printing unit destined to print text on the outside of the wrapper whereby the controller assigned to the wrapping station is embodied to control the printing proces carried out by said printing unit based on information recieved through the network from the central computer.

Another preferred embodiment has the characteristic that the wrapping station is combined with a labeling and printing unit destined to print text on a succeeding series of labels and to attach each label to the outside of the wrapper wrapped around each book or magazine by the wrapping station, whereby the controller assigned to the combined wrapping, labeling and printing station is embodied to control the printing process carried out by said printing unit based on information received through the network from the central computer.

The invention will be described hereafter in more detail with reference to an embodiment thereof illustrated in the attached drawings.

Figure 2:
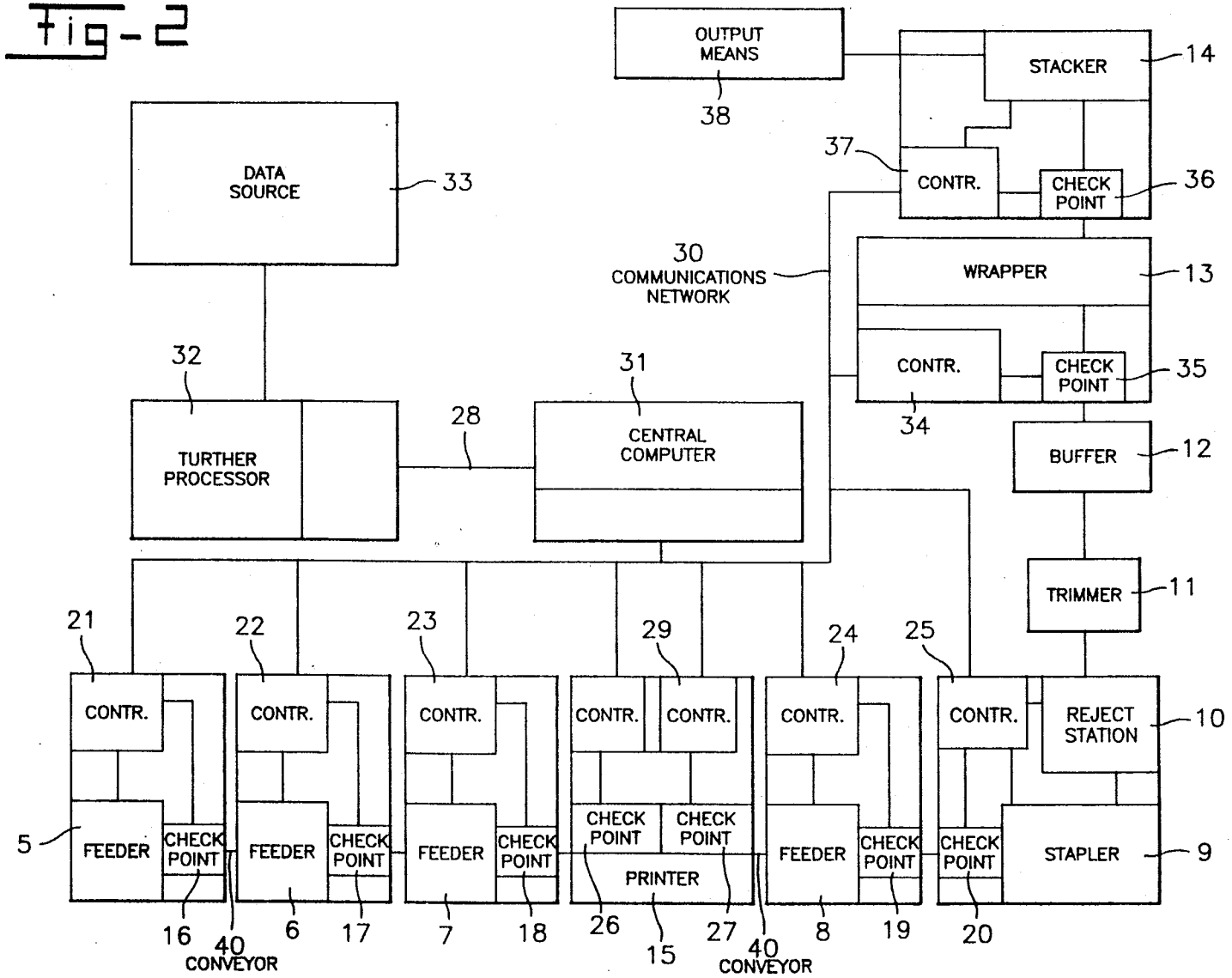

FIG. 1 illustrates schematically the structure of a magazine, collated in agreement with the invention and FIG. 2 illustrates a block diagram of the system according to the invention.

FIG. 1 illustrates schematically the structure of a book or magazine. The magazine is collated from the signatures 1, 2 and 3 and a cover 1' which are attached to each other, for instance by staples 4. Such signatures are delivered in piles by the printer to the bindery. With the help of a series of so called signature feeding stations, arranged in a collating line, the signatures are collated one on top of the other in the correct order. It is also possible to arrange the signatures adjacent to each other. Thereafter the signatures are stapled and bundled.

In FIG. 2 an embodiment of the system according to underlying invention is illustrated in the form of block diagram. The system comprises four signature feeder stations which are indicated by 5, 6, 7 and 8. These signature feeder stations are arranged such that they are able to cooperate with a conveyer 40. In practice said conveyer runs through each of the signature stations and through a number of other stations which will be discussed later and is destined to transport the signatures along the various stations. As a signature or a pile of signatures passes through a feeder station, said feeder station will add a further signature from his own stock under control of a processor as will be described later. In FIG. 1 only small sections of the conveyer 40 between the various stations are visable.

Between the signature feeders 7 and 8 a printing station 15 comprising in the shown embodiment two printing heads is installed. The function of this printing station 15 is to print customized text on the upper surface of the uppermost siganture of each pile of signanures passing the printing station 15.

At the downstream end of the row of signature feeders a stapling machine 9 is installed destined to attach the collated signatures carried by the conveyer for instance by inserting one or more staples at the correct positions in the collated signatures. This stapling machine is followed by a reject station 10 destined to remove defective or non-correct products from the conveyer. In the embodiment shown in the figure the stapling machine 9 and the reject station 10 are combined into one working station, however, it will be clear that both stations can be embodied as separate stations.

The reject station is followed by a trimmer 11 for trimming the collated signatures to obtain prescribed dimensions together with a neat appearance of the finished book or magazine.

At the downstream end of the conveyer 40 a supply buffer 12 is installed which recieves the finished books or magazines from the trimmer adds the received books to a temporary queue inside the buffer station, and delivers books from the queue according to the first in first out principle to the wrapping and labelling unit 13.

In the wrapping and labeling unit 13 a paper wrapper (or eventually a poly wrapper) is wrapped around the finished book or magazine and the address of the person or organization who is going to receive this specific book or magazine is printed on the wrapper or is otherwise put in or on the wrapper as will be described later in more detail.

The products leaving the wrapping and labeling unit are supplied to a stacker 14 which provides piles of books or magazines to an output means 38.

The whole system can be subdivided in two sections. The first section consists of the feeder stations 5, 6, 7 and 8, the printing station 15, the stitching or stapling station 9 and the trimmer 11. The second section comprises the wrapping and labelling unit 13 and the stacker 14. In general both sections will not operate at exactly the same speed. In a practical solution the stations belonging to the first section will be coupled to the same drive means and will run therefor synchronously. However, there is no need to couple the stations of the second section to the same drive means, in most cases such a coupling would lead to mechanical problems and most designers will therefor avoid said coupling. The function of the buffer station 12 is now to provide a transfer means for transferring products from the first section to the second section while both sections are running asynchronously.

Following each feeder station 5, 6, 7 and 8, a checkpoint is installed indicated by 16, 17, 18 and 19 respectively. A checkpoint at the entrance of the stapling machine 9 is indicated by 20. The printing unit 15 comprises two checkpoints 26 and 27, one for each of the two printing heads in this embodiment of the printing station 15. The function of these checkpoints is to check the proper functioning of the related station.

All the components of the system described above, especially all the mechanical parts of the feeder stations, the printing station, the stapler, the trimmer, the wrapping and labeling station, the stacker and the checkpoints are considered as known to the expert in this field and a further detailed description thereof is considered superfluous.

According to the invention, each of the workstations has its own controller. The controller unit for feeder station 5 is indicated by 21, the one destined for the feeder station 6 is indicated by 22, the one destined for feeder station 7 is indicated by 23 and the one destined for feeder station 8 is indicated by 24. The combination of the stapling machine 9 and the reject station 10 for rejecting defective products is controlled by the controller 25. The printing station 15 is controlled by a double controller 29.

In this embodiment the trimmer 11 does not need a controller and the same applies to the buffer station 12. However configurations comprising a controller in the trimmer as well as in the buffer station are certainly conceivable within the scope of the invention.

The controller assigned to wrapping and labeling station 13 is indicated by 34 and the controller assigned to the stacker 14 is indicated by 37.

As is shown schematically in the figure each controller is not only connected to the corresponding workstation to send instructions to said workstation, but is also connected to the checkpoint(s) assigned to said workstation to receive therefrom information indicating if the workstation is functioning properly or not. If a feeder station receives the instruction to feed a signature to the conveyer the checkpoint will detect that the signature indeed was fed. If because of malfunctioning of the feeder station no signature was fed, although the instruction to feed a signature was sent by the controller then the checkpoint will transfer a corresponding error signal to the controller. The same applies to the situation in which a signature was fed, although the feeder was instructed not to feed a signature.

It will be clear that the checkpoints for the other stations have similar tasks and will also send error signals to the corresponding controller in case the workstation, the functioning of which is controlled, is not functioning correctly.

The controller units are not only connected in the above described manner to the workstations and checkpoints but are furthermore connected to a communications network 30. This communications network 30 handles the transfer of messages between the various controllers and a central computer 31. The whole network 30 can be embodied for instance as a so called modified ETHERNET (in general a network complying with IEEE 802.3 or IEEE802.4 ) network which is considered known to the expert in this field and therefor does not need detailed explanation.

The central computer 31 is connected through a further network 28 to a further processor or computer 32 which may receive data from a data source 33. The further network 28 may form part of a generally known network such as for instance an ETHERNET configuration which does not need further explanation.

The above described system can be used for customizing for instance books or magazines. Customizing implies that not in every magazine or book all the available signatures will be present and that furthermore specific text may be printed on specific signatures, on the cover or on the wrapper depending on the person or organization the book or magazine is destined for. Predetermined readers or groups of readers will receive a specific signature whereas others will not receive this signature.

Before the mechanical parts of the system are put into operation first of all data about the persons or organisations who will receive the produced books or magazines has to be loaded from the data source 33 in the computer or processor 32. These data comprises, for instance, information about the age of the addressee, part of town where he lives, profession etc. In general, such data will be supplied in alphabetical order. However, if the books or magazines will be mailed, it is often preferred to sort the finished books or magazines according to postal code because most postal authorities handle reduced tariffs for sorted bundles of mail. Therefore the data, transferred to the processing unit 32 from the source 33 will have to be resorted according to said postal code. Thereafter the data obtained in this way will be supplied to the central computer 31 through the network 28.

It will be clear that depending on the circumstances the source 33, the processor 32 and the computer 31 can be combined into one intelligent unit such as a small computer. However as already remarked above in many practical situations the computer 32 will be positioned on the workfloor in the direct neighborhood of the various mechanical stations. The conditions on the workfloor are in general rather hostile for electronic equipment and therefor it is preferred to house the controllers and the central computer in suitable enclosures and to carry out any human-machine communication at the computer 32 which can be positioned in a sufficient clean environment even at a large distance of the actual workfloor.

The central computer supplies data related to a number (for instance 10) of magazines to be manufactured in groups or batches to the controllers 21–25, 29, 34, 37 in a coded message format. Each message comprising an network address of one of the controllers in combination with data needed in the respective controller to generate appropriate instructions to the related workstation is placed on the network 30. All controllers are constantly listening to the network and will receive those messages carrying their own address. The received messages will be stored and translated in workstation control signals which will be generated at the correct timing to obtain the desired functioning of the controlled workstation.

Suppose now that the system is initiated, that data relating to the first batch of magazines is transferred to the various controllers and that the first magazine to be produced should not contain the signature available in station 7 (signature 1 in the order illustrated in FIG. 1). After starting the system feeder station 5 will feed a signature 3 to the conveyer 40 under control of an instruction issued by the controller 21. Checkpoint 16 checks if indeed a signature is supplied. If a signature is supplied than this signature 3 will be transferred along the conveyor 40 to the next feeder station 6 where signature 2 is added to signature 3 under control of the controller 22. Checkpoint 17 checks at the output of feeder station 6 if indeed a signature 2 was added to the already present signature 3. If the check carried out by checkpoint 17 is affirmative the now formed magazine section comprising the signatures 3 and 2 will be transferred to feeder station 7.

As above described it supposed that this specific magazine shall not comprise signature 1, which is available in feeder station 7. The feeder station 7 is controlled by the control unit 23 in such a manner that no signature 1 will be added to the magazine section. The fact that no signature 1 is added will be checked in the checkpoint 18. If the checkpoint confirms the proper functioning of feeder station 7 the now formed magazine section still comprising only the signatures 2 and 3 is transferred to the printer 15.

In the printer 15 data may be printed on the upper surface of the upper signature (in this case signature 2) using two different printing heads 26, 27 controlled by the double control unit 29. Thereafter the magazine section is transferred to the feeder station 8 where the cover 1' is added under control of the control unit 24. A check is carried out in the checkpoint 19.

The now completely collated magazine is transferred thereafter to the stapling machine 9 but, before entering this machine, a further check on the thickness and the correct mutual positioning of the signatures is carried out in the checkpoint 20. In this embodiment of the system the stapling machine 9 inserts three staples 4 into the signatures for reasons to be discussed later.

From the stapler station 11 the magazine is conveyed to the trimmer 11 in which the three free edges of the magazine are cut to the correct dimensions. Thereafter the now finished magazine is conveyed further to the buffer station 12.

In buffer station 12 the magazines are added to, one side of a queue whereas simultaneously magazines are taken from the other end of the queue and delivered to the wrapping and labeling station 36. If in this wrapping and labeling station 36 a specific address has to be printed on the wrapper of the magazine which is customized to the needs of the respective addressee then it will be necessary to be able to identify the various magazines received from the buffer station in case one magazine is rejected by the rejection station 10 because of malfunctioning of one of the upstream workstations. That implies that some sort of identification mark will have to be attached to the magazines before they enter the buffer station 10. There are various possibilities one of which will be described in more detail later.

After individualizing the magazine in the wrapping and labelling unit 13 a wrapper with the name and address of the related end user is wrapped around the magazine under control of the controller 34. The address on the wrapper may be printed on the wrapper in situ using one or more print heads integrated in the wrapping station or installed directly downstream of said wrapping station. Another possibility is to use a separate label printer operating synchronously with the wrapping station 13 under control of controller 34 or eventually under control of a separate controller supplying printed labels to the wrapping station which labels are adhered to the wrapper (or enclosed inside the wrapper in case the wrapper is made of transparent material).

Downstream of the wrapping and labelling unit 13 a further check is carried out by the checkpoint 36. Under control of the control unit 37 the magazine will be transferred thereafter to the stacker 14 supplying piles of finished and wrapped magazines to an output station 38.

As explained above it will be necessary to attach some mark to the magazines entering the buffer station 12 in case part of the customization process is carried out in the wrapping and labeling station 13. A possible way of marking each magazine is to provide each of the staples, inserted in the magazines in stapler 9, with a predetermined magnetic orientation which is indicated schematically in FIG. 1. This can be carried out by manipulating premagnetized staples or by magnetizing the staples in situ. The orientation of the staples is controlled by the controller 25. Methods and means for providing a magnetization to the staples are considered known as such and do not need further explanation. If three staples are used for each magazine as in the selected example than eight unique codes can be produced by varying those codes numerous sequences can be derived, for instance 01234567876543210123 etc. Although this number seems rather restricted it is in practice sufficient to receive in checkpoint 35 at the input of the wrapping station an indication if a magazine is missing or not.

It will now be described what happens in case somewhere an error is detected by one of the checkpoints. With reference to the above described example the first possible error which will be discussed is the erroneous addition of a signature 1 to the magazine by the feeder unit 7 although the message supplied to the control unit 23 indicate otherwise. If this happens the checkpoint 18 will detect that a signature is erroneously feeded. This fact will be reported to the controller 23 and through the network 30 to the central computer 31. The computer 31 now will transmit messages to all workstations downstream of the checkpoint 18. The result thereof will be that the respective magazine will not be processed any further in the downstream station and will be removed from the conveyor by means of the reject station 10. So the printing station 15, the feeder station 8 and the stapler 9 are controlled such that they remain inactive for the time the defective magazine passes said stations. Furthermore the central computer will take care that the messages to be sent to all workstations relating to the next batch of magazines to be produced will contain a new set of data related to the now rejected magazine. Because this new set of data will not be processed directly by the various feeder stations, caused by the fact that the various controllers receive their information in batches relating to a number of (mutually different) the replacing magazine will be processed some time later.

The above described error of feeding the signature 1 will not only be detected in the checkpoint 18, but also in the checkpoint 20. That means that there is a double check on errors. The rejection of the defective magazine implies furthermore that the controllers 34, 35 have to receive information from the central computer 31 to avoid that wrong addresses will be printed on the magazines directly following the rejected magazine.

The system will take similar action in case one of the feeder stations 5, 6 or 8 does not supply a signature to the conveyor 40 in contrast to its instructions. Also if an error is detected in the printing process than the manufacturing process will be interrupted in a similar manner.

Another defect which can be detected is the missing of a magazine between the stapling machine 9 and the checkpoint 35. Because the wrapping and labelling unit 13 stands separate from the first section of the system errors may occur. As is described above each magazine in this embodiment comprises three N-S-magnetized staples. By using three staples a sufficiently large number of combinations are possible. (If necessary also the magnetization intensity can be varied providing further coding scemes). By supplying successive groups of magazines successively with the same order of combinations to the checkpoint 35 it is easy to detect if a magazine is missing or not. If a magazine is missing this fact will be reported to the controller 34. Based on the data used for printing the label on the last correctly processed magazine the controller 34 is able to determine exactly which magazine is missing. The respective information is transferred through the network 30 to the computer 31 which takes care in the above-described manner that data for producing a replacement magazine will be transferred with the next batch to the various controllers. If predetermined coding is missing, then by means of the processing unit 31 it is possible to determine which specific magazine is missing.

Although a magnetic coding of the staples is preferred because this type of coding is not visible for the addressee it is possible to apply other marks on the magazine, for instance a bar code using a bar code printer to print the code on the cover signature.

Although above the invention is described based on a preferred embodiment thereof it will be clear that various amendments can be carried out within the scope of the underlying invention. It will be clear that the combination of signature feeders/printers/stapling machine can be varied and/or extended. Furthermore it is possible to alter the devices downstream of the stapling machine 9.

We claim:

1. System for collating and binding signatures to produce customized versions of books or magazines, comprising a conveyer running along a number of workstations, said workstations including at least one number of the following stations:

a number of feeder stations for feeding one signature to said conveyer to form a collation of signatures, a number of printer stations for printing a predetermined text on the upper signature of the collation passing the station on said conveyer, a stitching station for binding the collated signatures on the conveyer to obtain a book or magazine, a number of checkpoints, one for each of the said stations, for checking the correct functioning of the respective station, a reject station downstream of said station for removing defective books or magazines, a computer system for receiving data from a source of data relating to the embodiment of each book or magazine to be produced and information relating to the functioning of the various stations and for transferring control messages to said various stations, characterized in that, said computer system comprises a number of controllers, one for each of said stations, each controller receiving information from the checkpoint assigned to the same station and outputting commands to the respective station to control the functioning thereof, a central processor for receiving the data from said data source and for generating control messages to each of the controllers, a communication network to which all controllers as well as the central processor are connected by uniform connecting means to transfer information about the functioning of the various stations from the controllers to the central station, whereby during operation of the system each controller is loaded with suitable software enabling the controller to control the functioning of the assigned station independent of the other controllers and whereby the transfer of a message indicating the malfunctioning of one of said stations from the respective controller to the central processor will cause the central processor to send a message to the printer stations, feeder stations and stitching station downstream of the station in which the malfunctioning occurred instructing these stations to stop the further production of the book or magazine influenced by said malfunctioning, to send a message to the reject station to reject said non-completed book or magazine and to send messages to all stations to update the data defining the magazines or books to be produced such that a replacement for the rejected non-completed book or magazine will be produced.

2. System according to claim 1, characterized in that, the system comprises a further processor, functioning as said abovementioned source of data, coupled to said central processor and destined to receive information about the persons or organisations who will receive one of the books or magazines produced by the system and customized to their specific needs, which further processor is programmed to convert said information into data relating to the books or magazines to be produced by the system and to transfer said lastmentioned data to the central processor.

3. System according to claim 1, characterized in that, the system comprises furthermore a station for trimming the found books or magazines which have passed the rejection station, a wrapping station and a buffer station, a separate controller and checkpoint being assigned to said wrapping station, whereby the trimming station receives the books or magazines from said conveyer and supplies the trimmed books or magazines to said buffer station which is positioned at the end of the conveyer, and whereby the buffer station places the received books or magazines in a queue from which the books are magazines or supplied to the wrapping station at a rate which is dependent on the functioning speed of said wrapping station.

4. System according to claim 3, characterized in that the wrapping station is combined with a printing unit destined to print text on the outside of the wrapper whereby the controller assigned to the wrapping station is embodied to control the printing process carried out by said printing unit based on information receives through the network from the central computer.

5. System according to claim 3, characterized in that the wrapping station is combined with a labeling and printing unit destined to print text on a succeeding series of labels and to attach each label to the outside of the wrapper wrapped around each book or magazine by wrapping station, whereby the controller assigned to the combined wrapping, labeling and printing station controls the printing process carried out by said printing unit based on information received through the network from the central computer.

6. System according claim 3, characterized in that, the system comprises furthermore a sorting station for sorting the books or magazines received from the wraping station in a number of different bundles dependent on the postal code of the person or organisation who is to receive the respective book or magazine, said sorting station comprising room for one or more bundles which have to wait until a replacement book or magazine arrives at the sorting station, said sorting station being controlled by a separate controller which is also coupled to said network to receive information relating to the arrival of replacement books or magazines.

7. System according to claim 1, characterized in that, a uniform interface is used to connect each controller to the communications network.

8. System according to claim 1 characterized in that, the stitching station is combined with means to provide a coding on each book or magazine, the number of different codes being sufficient to distinguish at least the books or magazines present in the queue in said buffer station, that the wrapping station is combined with means to detect said code and to supply corresponding information to the controller assigned to the wrapping station.

9. System to claim 1, characterized in that, the stitching station is embodied as a stapling station destined to insert two or more staples in the collated signatures and that the means to provide a coding on each book or magazine is embodied to provide each staple with a magnetization of predetermined direction and/or intensity, the combination of different magnetization directions forming the abovementioned code.

* * * * *